US012291858B2

(12) United States Patent
Weatherby

(10) Patent No.: US 12,291,858 B2
(45) Date of Patent: May 6, 2025

(54) MODULAR ASSEMBLY INCLUDING MULTIPLE MODULES

(71) Applicant: Topk USA LLC, Gray, TN (US)

(72) Inventor: Stan Weatherby, Gray, TN (US)

(73) Assignee: TOPK USA LLC, Gray, TN (US)

( * ) Notice: Subject to any disclaimer, the term of this patent is extended or adjusted under 35 U.S.C. 154(b) by 0 days.

(21) Appl. No.: 18/427,342

(22) Filed: Jan. 30, 2024

(65) Prior Publication Data

US 2024/0254752 A1 Aug. 1, 2024

Related U.S. Application Data

(60) Provisional application No. 63/482,362, filed on Jan. 31, 2023.

(51) Int. Cl.

| | |
|---|---|
| ***E04B 1/34*** | (2006.01) |
| ***E04B 1/343*** | (2006.01) |
| ***E04B 1/68*** | (2006.01) |

(52) U.S. Cl.

CPC ..... *E04B 1/34317* (2023.08); *E04B 1/68* (2013.01)

(58) Field of Classification Search

CPC ..... E04B 1/343; E04B 1/34336; E04B 1/388; E04B 1/6812; E04B 1/34317; E04B 1/68; E04H 2005/005; E04H 1/00; E04H 1/12; E04H 1/1205; E04H 2001/1283

See application file for complete search history.

(56) References Cited

U.S. PATENT DOCUMENTS

| | | | | |
|---|---|---|---|---|
| 3,182,424 | A | 5/1965 | Betjemann | |
| 3,363,383 | A * | 1/1968 | La Barge | E04B 1/68 52/287.1 |
| 3,971,172 | A * | 7/1976 | Gentil | E04B 1/24 52/28 |
| 4,075,814 | A | 2/1978 | Theurer | |
| 4,599,829 | A | 7/1986 | Dimartino, Sr. | |
| 4,854,094 | A | 8/1989 | Clark | |
| 4,891,919 | A | 1/1990 | Palibroda | |
| 5,285,604 | A | 2/1994 | Carlin | |
| 5,317,857 | A | 6/1994 | Allison | |

(Continued)

FOREIGN PATENT DOCUMENTS

| | | | |
|---|---|---|---|
| CA | 2911779 | A1 | 5/2016 |
| CN | 109477333 | A | 3/2019 |

(Continued)

*Primary Examiner* — Patrick J Maestri

(74) *Attorney, Agent, or Firm* — Greenberg Traurig, LLP

(57) ABSTRACT

A modular assembly, including a first module, a second module, and a third module, each including upper and lower walls, a first end wall extending between the upper wall and the lower wall, a second end wall opposite the first end wall, and extending between the upper wall and the lower wall, and a first side wall extending between the upper wall and the lower wall, and between the first end wall and the second end wall. The first side wall defines a first opening, where the second module includes a second side wall extending between the upper wall of the second module and the lower wall of the second module, and between the first end wall of the second module and the second end wall of the second module. The second side wall defines a second opening and interior and exterior seals between the first, second, and third modules.

18 Claims, 15 Drawing Sheets

(56) References Cited

U.S. PATENT DOCUMENTS

| | | | | |
|---|---|---|---|---|
| 5,353,557 | A | 10/1994 | Lerner | |
| 5,706,614 | A | 1/1998 | Wiley, Jr. | |
| 5,735,639 | A | 4/1998 | Payne | |
| 5,950,373 | A | 9/1999 | Von Hoff | |
| 6,330,771 | B1 | 12/2001 | Hester, Jr. | |
| 6,983,567 | B2 | 1/2006 | Ciotti | |
| 7,827,738 | B2 | 11/2010 | Abrams | |
| 8,001,730 | B2 | 8/2011 | Wallance | |
| 8,166,715 | B2 | 5/2012 | De Azambuja | |
| 8,291,647 | B2 | 10/2012 | Esposito | |
| 8,347,560 | B2 | 1/2013 | Gyory | |
| 8,397,441 | B2 | 3/2013 | Wallance | |
| 8,484,929 | B1 | 7/2013 | Begdouri | |
| 8,826,600 | B2 | 9/2014 | Wallance | |
| 8,973,335 | B2 | 3/2015 | Wilson | |
| 8,991,134 | B2 | 3/2015 | Wheeler | |
| 9,085,890 | B2 | 7/2015 | Strickland | |
| 9,115,504 | B2 | 8/2015 | Wallance | |
| 9,121,168 | B2 | 9/2015 | Levy | |
| D765,266 | S | 8/2016 | Malakauskas | |
| 9,631,365 | B2 | 4/2017 | Bottin | |
| 9,702,138 | B1 | 7/2017 | Rutherford | |
| D812,249 | S | 3/2018 | Jimenez Rivera | |
| 9,988,806 | B2 | 6/2018 | Segall | |
| D844,838 | S | 4/2019 | Li | |
| 10,265,232 | B2 | 4/2019 | Yim | |
| 10,309,119 | B2 | 6/2019 | Klein | |
| 10,352,034 | B2 | 7/2019 | Boyle | |
| 10,415,232 | B2 | 9/2019 | Li | |
| D881,413 | S | 4/2020 | Gill | |
| 10,689,840 | B2 | 6/2020 | Bonlin | |
| 10,704,251 | B1 | 7/2020 | Rubler | |
| 10,724,313 | B2 | 7/2020 | Walker | |
| 10,850,917 | B2 | 12/2020 | Ramandev | |
| 2001/0047628 | A1 | 12/2001 | Mouton | |
| 2003/0009954 | A1 | 1/2003 | Bradley | |
| 2003/0051417 | A1 | 3/2003 | Ciotti | |
| 2006/0185262 | A1* | 8/2006 | Abler | E04B 1/3442 52/64 |
| 2006/0185264 | A1 | 8/2006 | Donahue | |
| 2007/0094946 | A1 | 5/2007 | Schoeny | |
| 2007/0163184 | A1 | 7/2007 | Olesch | |
| 2007/0271857 | A1 | 11/2007 | Heather | |
| 2008/0094797 | A1 | 4/2008 | Coglitore | |
| 2008/0236056 | A1 | 10/2008 | Hourihan | |
| 2009/0223144 | A1 | 9/2009 | Leahy | |
| 2010/0018131 | A1 | 1/2010 | Green | |
| 2011/0036022 | A1 | 2/2011 | Hsu | |
| 2011/0162293 | A1* | 7/2011 | Levy | E04B 1/3483 52/79.9 |
| 2011/0214361 | A1* | 9/2011 | Ingjaldsdottir | E04B 1/3483 52/745.13 |
| 2012/0176011 | A1* | 7/2012 | Carr | E04H 5/02 312/236 |
| 2013/0014450 | A1 | 1/2013 | Esposito | |
| 2013/0232886 | A1 | 9/2013 | Yoder | |
| 2014/0008359 | A1 | 1/2014 | Ferren | |
| 2014/0298734 | A1* | 10/2014 | Rogers | E04B 1/34869 52/79.9 |
| 2015/0033639 | A1 | 2/2015 | Wilson | |
| 2015/0152634 | A1 | 6/2015 | Unger | |
| 2016/0130795 | A1 | 5/2016 | Downey | |
| 2017/0121990 | A1 | 5/2017 | Armstrong | |
| 2019/0249413 | A1 | 8/2019 | Brotherton | |
| 2019/0352984 | A1 | 11/2019 | Walker | |
| 2021/0062496 | A1 | 3/2021 | Rittmanic | |
| 2021/0180314 | A1 | 6/2021 | Banerjee | |

FOREIGN PATENT DOCUMENTS

| | | | |
|---|---|---|---|
| CN | 107074441 | A | 4/2020 |
| CN | 112911930 | A | 6/2021 |
| DE | 1953109 | A1 | 10/1969 |
| DE | 2519841 | A1 | 10/1978 |
| DE | 102017216160 | A1 | 3/2019 |
| EP | 653525 | A | 5/1995 |
| EP | 2581524 | A2 | 4/2013 |
| GB | 2214971 | A | 9/1989 |
| GB | 2420126 | A | 5/2006 |
| JP | 6894422 | B2 | 6/2021 |
| KR | 101594472 | B1 | 2/2016 |
| KR | 102099018 | B1 | 5/2020 |
| WO | 9311328 | A1 | 6/1993 |
| WO | 9311329 | A1 | 6/1993 |
| WO | 2015143566 | A1 | 10/2015 |
| WO | 2016077466 | A1 | 5/2016 |
| WO | 2017165455 | A1 | 9/2017 |

* cited by examiner

MODULAR ASSEMBLY INCLUDING MULTIPLE MODULES

CROSS-REFERENCE TO RELATED APPLICATION

This application claims the benefit of priority under 35 USC 119 to U.S. provisional patent application No. 63/482,362, titled "Modular Structure," filed Jan. 31, 2023, the disclosure of which is incorporated by reference herein in its entirety.

FIELD

The present invention is directed to a modular assembly, and, more specifically, to a modular assembly that includes at least two modules.

BACKGROUND

A modular assembly, such as a modular building assembly, uses components that are at least partially prefabricated, such as prefabricated in a factory. The prefabricated components are transported to a construction site. At the construction site, the components are assembled, thereby providing the modular building at the construction site.

SUMMARY

The Claims, rather than the Summary, define covered embodiments of the present invention. The Summary is a high-level overview of various aspects of the invention, and introduces concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

In some embodiments, a modular assembly comprises: a plurality of modules, wherein the plurality of modules comprises a first module, a second module, and a third module, wherein each of the first module, the second module, and the third module comprises: an upper wall, a lower wall opposite the upper wall, a first end wall extending between the upper wall and the lower wall, a second end wall opposite the first end wall, and extending between the upper wall and the lower wall, and a first side wall extending between the upper wall and the lower wall, and between the first end wall and the second end wall, wherein the first side wall defines a first opening, wherein the second module further comprises a second side wall extending between the upper wall of the second module and the lower wall of the second module, and between the first end wall of the second module and the second end wall of the second module, wherein the second side wall defines a second opening; a first interior seal between the first side wall of the first module and the first side wall of the second module; a second interior seal between the second side wall of the second module and the first side wall of the third module; a first exterior seal between the first end wall of the first module and the first end wall of the second module; a second exterior seal between the first end wall of the second module and the first end wall of the third module; a third exterior seal between the second end wall of the first module and the second end wall of the second module; a fourth exterior seal between the second end wall of the second module and the second end wall of the third module; a fifth exterior seal between the upper wall of the first module and the upper wall of the second module; and a sixth exterior seal between the upper wall of the second module and the upper wall of the third module.

In some embodiments, the modular assembly further comprises a foundation, wherein the foundation supports each of the first module, the second module, and the third module.

In some embodiments, the first interior seal comprises a gasket; and an adhesive, wherein the adhesive adheres the gasket to at least one of the first side wall of the first module or the first side wall of the second module.

In some embodiments, the first module further comprises a second side wall extending between the upper wall of the first module and the lower wall of the first module, and between the first end wall of the first module and the second end wall of the first module, wherein the second side wall of the first module includes a door.

In some embodiments, the first module comprises a second side wall extending between the upper wall of the first module and the lower wall of the first module, and between the first end wall of the first module and the second end wall of the first module, wherein the second side wall of the first module includes a window.

In some embodiments, the modular assembly further comprises a cover on at least one of the first exterior seal, the second exterior seal, the third exterior seal, the fourth exterior seal, the fifth exterior seal, or the sixth exterior seal.

In some embodiments, the modular assembly further comprises: a first cover on the first exterior seal; a second cover on the second exterior seal; a third cover on the third exterior seal; a fourth cover on the fourth exterior seal; a fifth cover on the fifth exterior seal; and a sixth cover on the sixth exterior seal.

In some embodiments, the module assembly further comprises at least one fastener, wherein the at least one fastener fastens the first module and the second module to one another.

In some embodiments, the first module further comprises a first fastener receiving portion on the lower wall of the first module, the second module further comprises a second fastener receiving portion on the lower wall of the second module, and the modular assembly further comprises a first fastener, wherein the first fastener fastens the first fastener receiving portion and the second fastener receiving portion to one another.

In some embodiments, the first module further comprises a first fastener receiving portion on the upper wall of the first module, the second module further comprises a second fastener receiving portion on the upper wall of the second module, and the modular assembly further comprises a first fastener, wherein the first fastener fastens the first fastener receiving portion and the second fastener receiving portion to one another.

In some embodiments, a modular assembly comprises: a plurality of modules, wherein the plurality of modules comprises a first module and a second module, wherein each of the first module and the second module comprises: an upper wall, a lower wall opposite the upper wall, a first end wall extending between the upper wall and the lower wall, a second end wall opposite the first end wall, and extending between the upper wall and the lower wall, and a first side wall extending between the upper wall and the lower wall, and between the first end wall and the second end wall, wherein the first side wall defines a first opening; a first interior seal between the first side wall of the first module and the first side wall of the second module; a first exterior seal between the first end wall of the first module and the first end wall of the second module; a second exterior seal between the second end wall of the first module and the second end wall of the second module; and a third exterior seal between the upper wall of the first module and the upper wall of the second module.

BRIEF DESCRIPTION OF THE DRAWINGS

This section refers to the drawings that form a part of this disclosure, and which illustrate some of the embodiments of structure, materials, and/or methods of the present invention described herein.

DETAILED DESCRIPTION

In addition to the benefits and improvements that the Specification discloses, other objects and advantages that the Specification provides will become apparent from the following description taken in conjunction with the accompanying figures. Although the description discloses and describes detailed embodiments of the present disclosure, the disclosed embodiments are merely illustrative of the disclosure that may be embodied in various forms. In addition, each of the examples given regarding the various embodiments of the disclosure are intended to be illustrative, and not restrictive.

Figure 1:
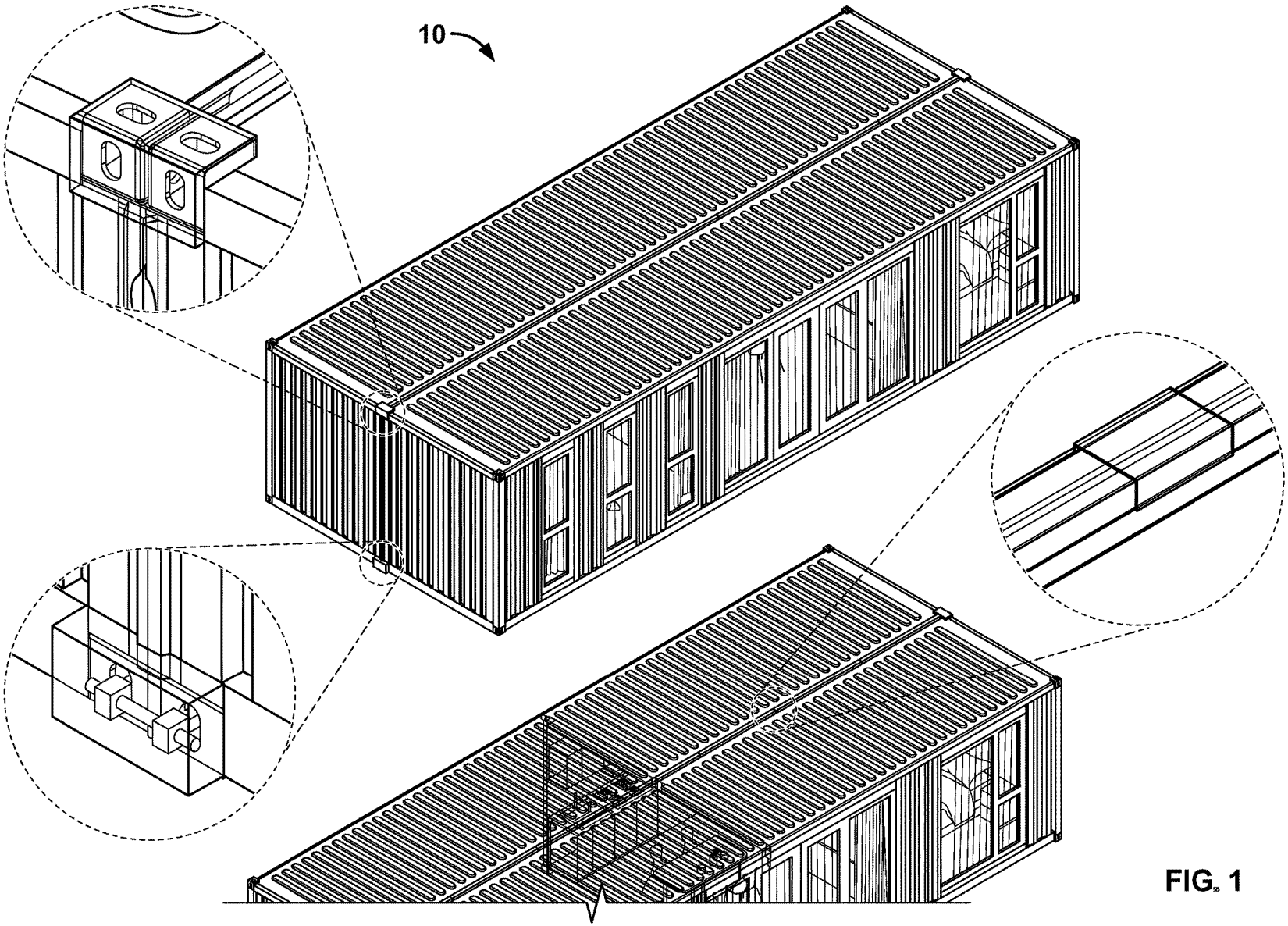
FIG. 1 is an isometric view of a modular structure or assembly, in accordance with some embodiments of the invention.

FIG. 1 is an isometric view of a modular structure 10 including three modules—a first module 12, a second module 14, and a third module 16—installed on a foundation 40, in accordance with some embodiments of the invention. In some embodiments, the modular structure 10 is assembled prior to assembly of the module structure 10 at the desired location. Although FIG. 1 shows the modular structure 10 including three modules—a first module 12, a second module 14, and a third module 16—in some embodiments, the modular structure 10 includes more or less modules. For example, in some embodiments, the modular structure 10 includes two modules—for example, the first module 12 and the third module 16. By way of another example, in some embodiments, the modular structure 10 includes more than three modules—for example, the first module 12, the third module 16, and two or more of the second modules 14 between the first module 12 and the third module 16.

FIGS. 2A, 2B, 2C, and 2D are interior, exterior, left, and right side views, respectively, of the first module 12, in accordance with some embodiments of the invention. As shown, in some embodiments, the modular structure 10 may be formed of a plurality of the modules, such as one the first module 12 (FIG. 2A-FIG. 2D), one the second module 14 (FIG. 3A-FIG. 3D), and one the third module 16 (FIG. 4A-FIG. 4D). Although reference herein is made to the modular structure including one of the first module 12, one of the second module 14, and one of the third module 16, it is understood that the modular structure 10 may be formed from combinations of one or more of the first module 12, one or more of the second module 14, and/or one or more of the third module 16. The first module 12, the second module 14, and/or the third module 16 may be sized according to International Organization for Standardization (ISO) standards. In some embodiments, the first module 12, the second module 14, and/or the third module 16 may be prefabricated, such that the first module 12, the second module 14, and/or the third module 16 are constructed at a manufacturing or other facility (e.g., a factory) prior to transportation of the first module 12, the second module 14, and/or the third module 16 to a desired location (e.g., construction or building site) of the modular structure 10. In some embodiments, the first module 12, the second module 14, and/or the third module 16 may be treated and subjected to additional processing after initial manufacturing thereof. In some embodiments, the treatment may be an anti-corrosion treatment. In some embodiments, the treatment may include primer. In some embodiments, the primer may include a zinc-enriched primer. In some embodiments, the primer may be on exterior and/or interior surfaces of the first module 12, the second module 14, and/or the third module 16. In some embodiments, one or more of the first module 12, the second module 14, and/or the third module 16 may be sprayed with a coating. In some embodiments, the coating may be enamel, such as but no limited to an acrylic enamel. In some embodiments, additional insulation or treatment of the first module 12, the second module 14, and/or the third module 16 may be provided, such as by treating a bottom portion of the first module 12, the second module 14, and/or the third module 16 with a vapor barrier and/or moisture protection.

Referring to FIG. 2A-FIG. 2D, in some embodiments, the first module 12 may be formed with a first arrangement of walls, windows, and other components. In some embodiments, the first module 12 may form an end portion of the modular structure 10. As described herein, in some embodiments, the first module 12 may include one or more windows, doors, and/or other portions located on at least one side of the first module 12, such that the first module 12 may form an end of the modular structure 10. As shown in FIG. 2A-FIG. 2D, in some embodiments, the first module 12 may have a side wall 18 that is substantially open or have one or more openings formed therethrough such that the side wall 18 may be aligned with the side wall 18 of an adjoining module as discussed in greater detail below. In some embodiments, the first module 12 may be constructed having opposing end walls 20 located on ends of the first module 12. In some embodiments, the opposing end walls 20 may be substantially solid, or may feature one or more windows 22 (FIG. 2C) and/or doors located on the opposing end walls 20. In some embodiments, the first module 12 may include a drip ledge 25 extending from the first module 12 and located above one or more of the windows 22. In some embodiments, the opposing end walls 20 and other portions of the first module 12 may be constructed, for example, from corrugated panels. In some embodiments, the panels may be steel panels. In some embodiments, the steel panels maybe 12 gauge steel panels, such as 12 gauge corten steel panels.

Figure 2A:
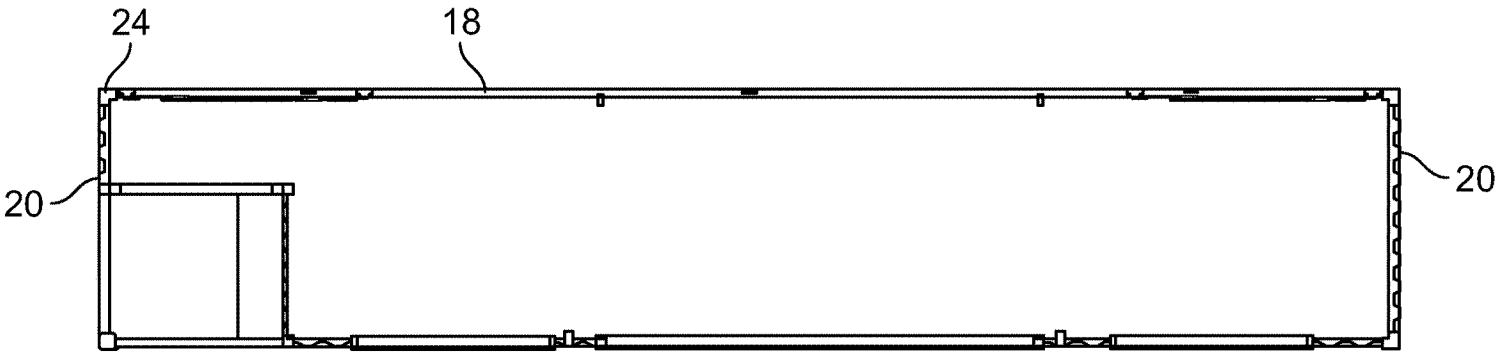
FIG. 2A is a top plan view of a first module of a modular structure or assembly, in accordance with some embodiments of the invention.
Figure 2B:
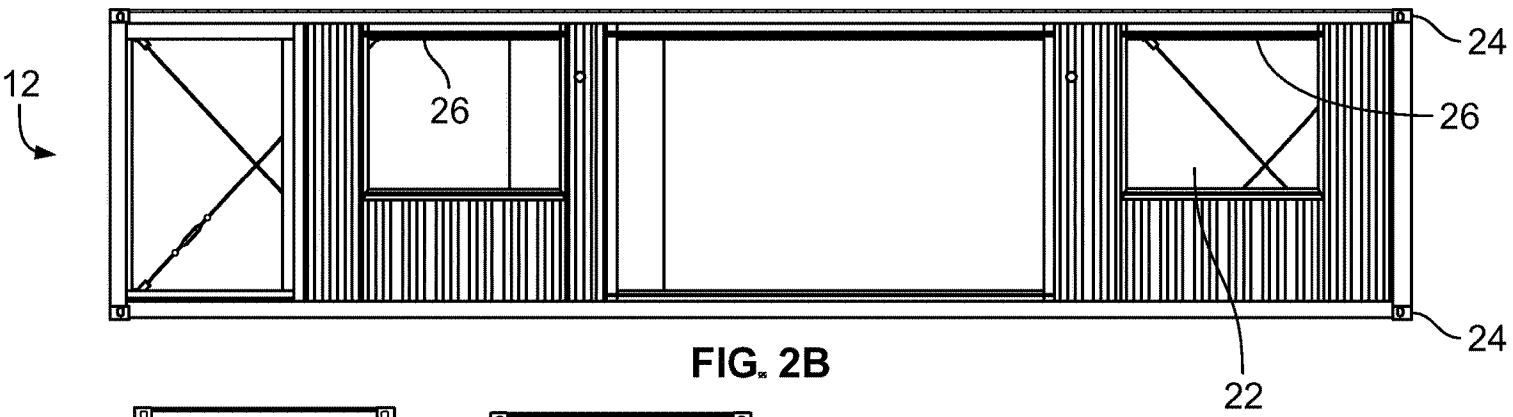
FIG. 2B is a front elevational view of the first module of FIG. 2A, in accordance with some embodiments of the invention.
Figure 2D:
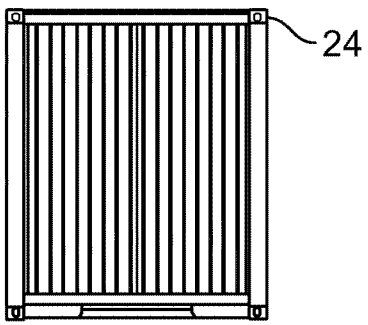
FIG. 2C and FIG. 2D are end views of the first module of FIG. 2A, in accordance with some embodiments of the invention.
Figure 2C:
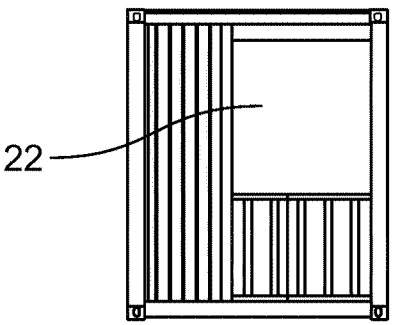

In some embodiments, the first module 12 may further include a plurality of corner castings 24 (FIG. 2B). In some embodiments, the plurality of corner castings 24 may be located towards corners of the first module 12. In some embodiments, the plurality of corner castings 24 may be positioned and shaped such that the plurality of corner castings 24 may secure the first module 12 during transportation, such as using transportation infrastructure for shipping containers. In some embodiments, the plurality of corner castings 24 may include apertures and/or other portions suitable for securing the first module 12 for transportation similar to a shipping container.

Still referring to FIG. 2A-FIG. 2D, in some embodiments, the modular structure 10 includes the second module 14. The second module 14 may be constructed having dimensions that are substantially the same as corresponding dimensions of the first module 12. As shown in the figures, in some embodiments, the second module 14 may be a center or middle portion of the modular structure 10, such that the first module 12 and the third module 16 may be secured on opposing sides of the second module 14. In some embodiments, the second module 14 may include the plurality of corner castings 24 and opposing end walls 20. In some embodiments, the second module 14 may include substantially open side walls, such that the second module 14 may be joined with the first module 12 and the third module 16, such that the second module 14 is located between the first module 12 and the third module 16. In some embodiments, the second module 14 may further include a plurality of brace members 26, such as cables or other members, to maintain a structure of the second module 14 during transportation and construction of the modular structure 10. The plurality of brace members 26 may extend, for example, between a roof portion of the second module 14 and a floor portion of the second module 14.

FIG. 3A-3D show the third module 16, in accordance with some embodiments of the invention. In some embodiments, the third module 16 may be constructed having dimensions that are substantially the same as dimensions of the first module 12 and/or the second module 14. As shown in the figures, in some embodiments, the third module 16 may include the side wall 18 that is substantially open, such that the third module 16 may be joined with the first module 12 and/or the second module 14. In some embodiments, the third module 16 may include the plurality of corner castings 24 and opposing end walls 20. In some embodiments, at least one side wall of the third module 16 may include the one or more windows 22. In some embodiments, one or more of the first module 12, the second module 14, and/or the third module 16 may include an upper wall and a lower wall, that form, for example, the uppermost surface and the lowermost surface of the first module 12, the second module 14, and/or the third module 16.

As shown, in some embodiments, the modular structure 10 may be formed of one or more of the first module 12, one or more of the second module 14, and/or one or more of the third module 16. For example, as the figures show, in an embodiment the modular structure 10 includes one of the first module 12, one of the second module 14, and one of the third module 16, secured to one another to form the modular structure 10. In some embodiments, the modular structure 10 may include one of the first module 12, two or more of the second module 14, and one of the third module 16.

Figure 3A:
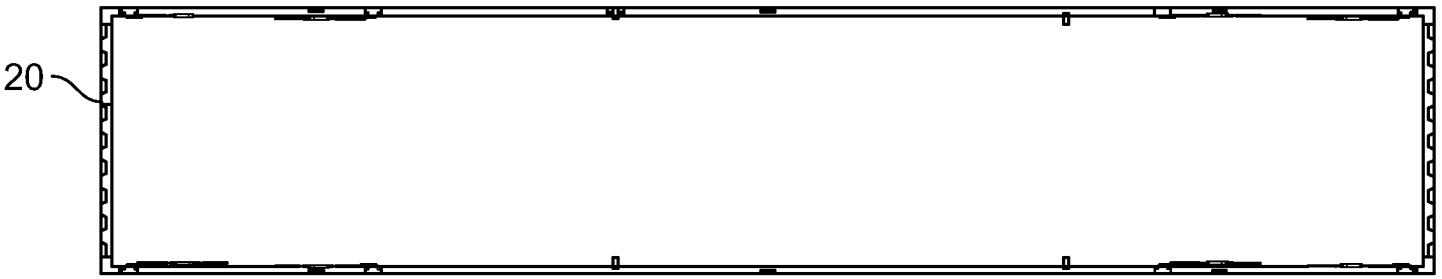
FIG. 3A is a top plan view of a second module of a modular structure or assembly, in accordance with some embodiments of the invention.
Figure 3B:
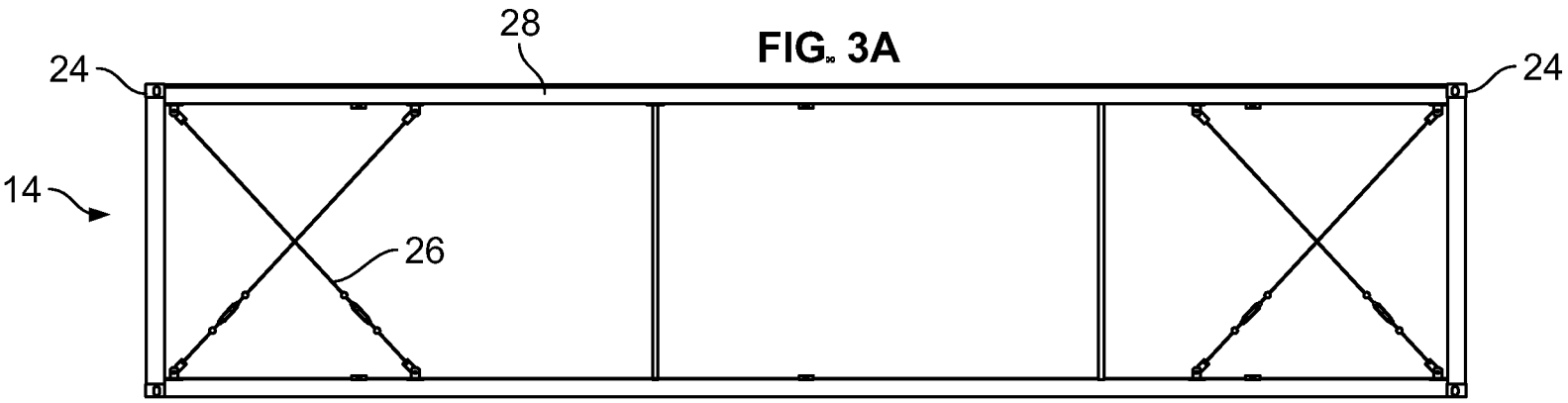
FIG. 3B is a front elevational view of the second module of FIG. 3A, in accordance with some embodiments of the invention.
Figure 3D:
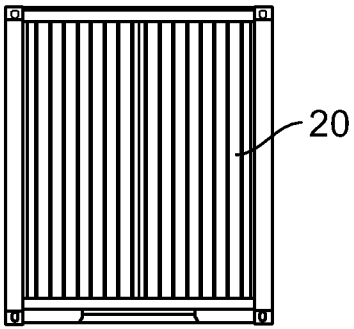
FIG. 3C and FIG. 3D are end views of the first module of FIG. 2A, in accordance with some embodiments of the invention.
Figure 3C:
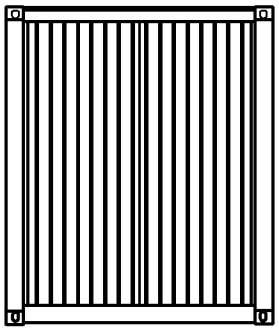
Figures 4A, 4B, 4C, 4D:
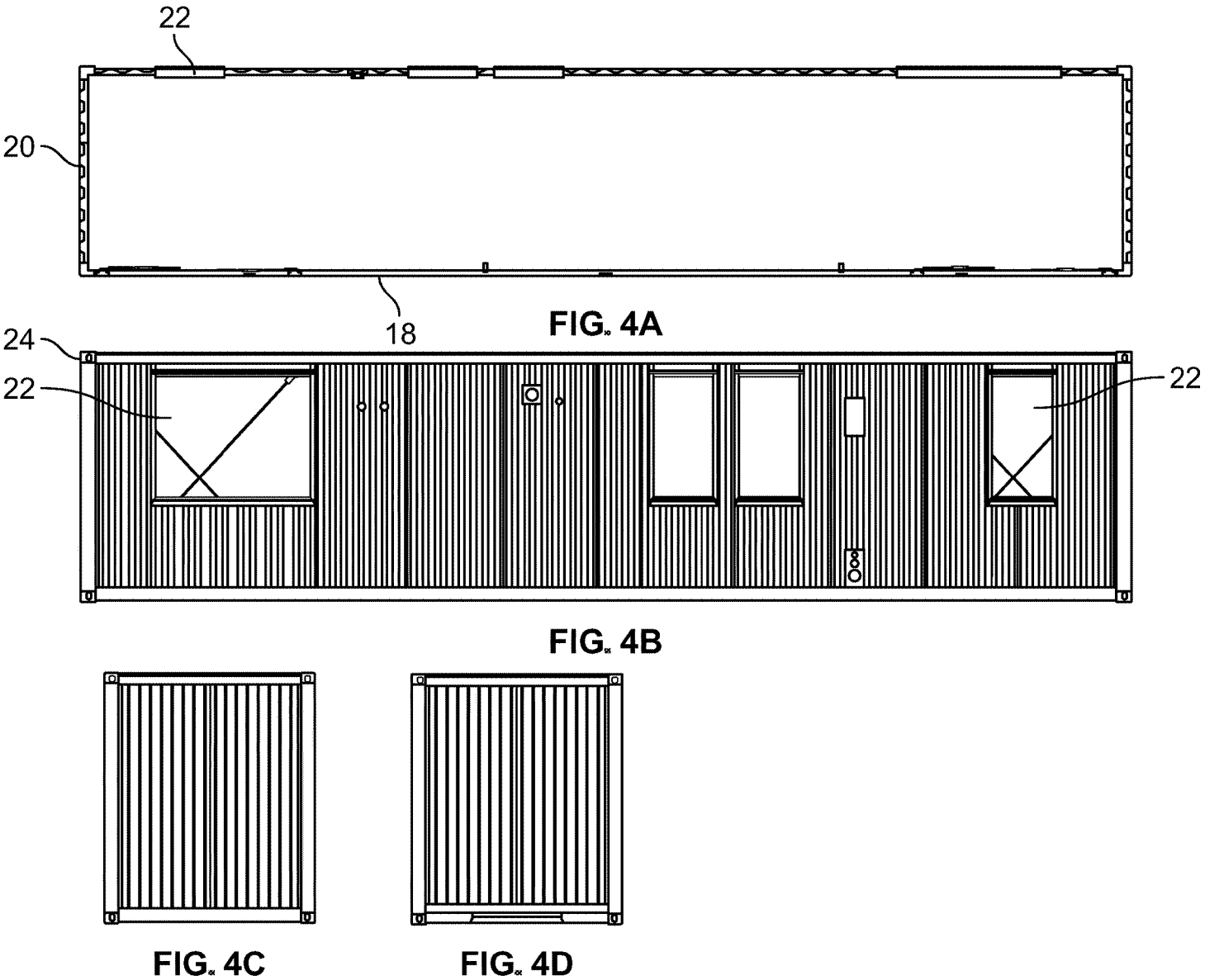
FIG. 4A is a top plan view of a third module of a modular structure or assembly, in accordance with some embodiments of the invention.
FIG. 4B is a front elevational view of the third module of FIG. 4A, in accordance with some embodiments of the invention.
FIG. 4C and FIG. 4D show end views of the third module of FIG. 4A, in accordance with some embodiments of the invention.

In some embodiments, the first module 12, the second module 14, and the third module 16 are configured to be connected with one another to form the modular structure 10. As shown in FIG. 3B, each of the first module 12, the second module 14, and the third module 16 may include a flange area 28 that is located around the side wall 18. The flange area 28 may provide for a substantially flat surface area along side edges of the side wall 18 to provide an area for securing of the modules with one another when forming the modular structure 10. The flange area 28 may be formed along or around side edges of the side wall 18 and be located at least partially between the plurality of corner castings 24.

Figure 5:
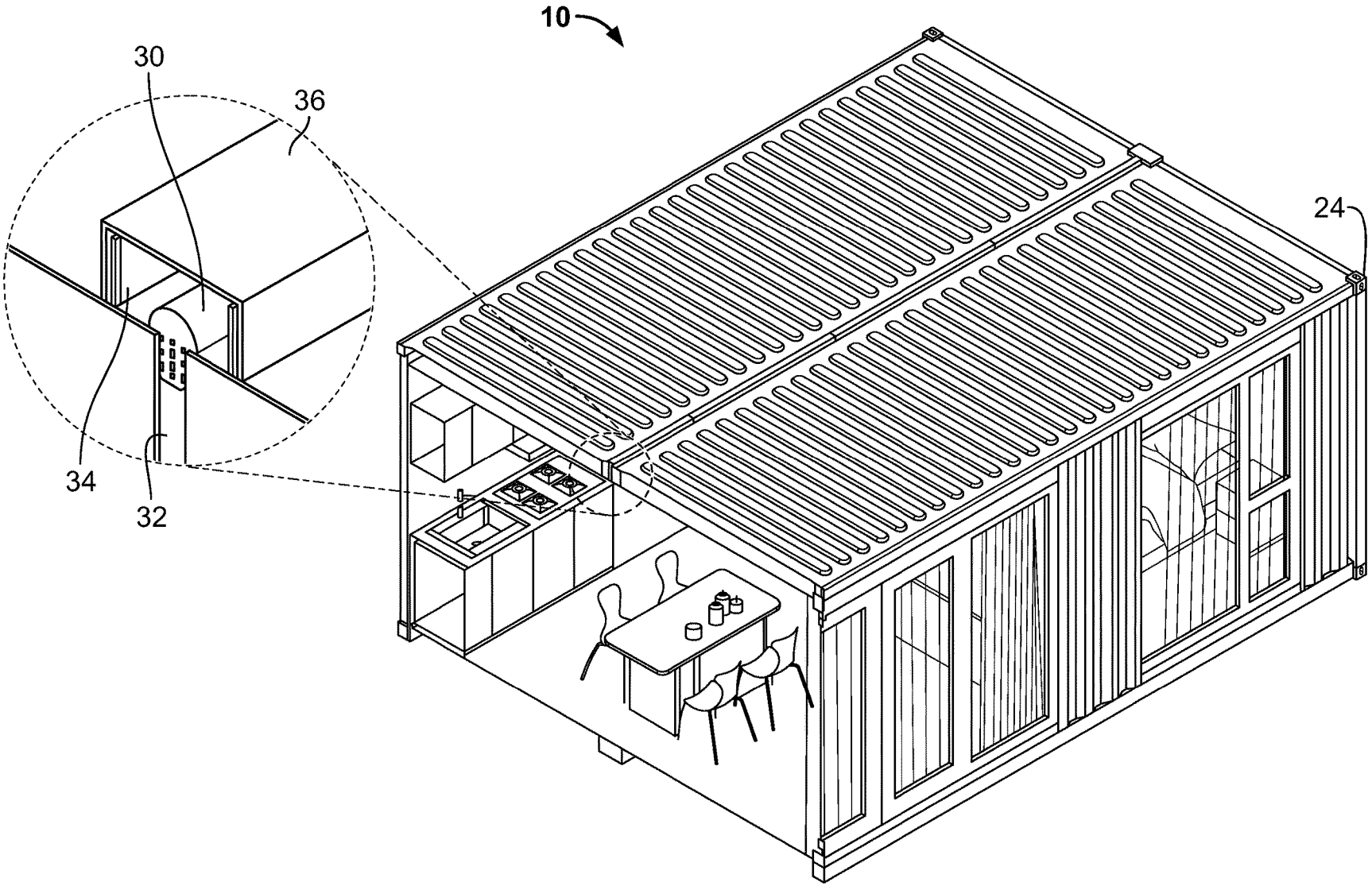
FIG. 5 is a cross-sectional view of a modular structure or assembly, in accordance with some embodiments of the invention.

With reference to FIG. 5, the first module 12, the second module 14, and the third module 16 may be joined with one another such that a water-resistant or watertight seal is formed, to make the modular structure 10 substantially weatherproof. As shown in the detail view in FIG. 5, an exterior seal or sealing member 30 may be located between portions of the modules forming the modular structure 10. In some embodiments, the sealing member 30 may be substantially T-shaped. In some embodiments, the sealing member 30 may include a first portion that extends between the first module 12, the second module 14, and/or the third module 16, and a second portion that extends across a gap 32 located between the first module 12, the second module 14, and/or the third module 16. The first module 12, the second module 14, and/or the third module 16 may include a baffle 34 extending from a surface of the modules. In some embodiments, the baffle 34 may be located proximate an edge of the first module 12, the second module 14, and/or the third module 16, where the first module 12, the second module 14, and/or the third module 16 are joined together. In some embodiments, a cover 36 may be located over the gap 32 formed between the first module 12, the second module 14, and/or the third module 16. In some embodiments, the cover 36 may be arranged to fit against the baffle 34 of each the first module 12, the second module 14, and/or the third module 16, to substantially cover the portion where the modules are joined. Thus, in some embodiments, the cover 36 may reduce intrusion of water, dust, or other elements through joints between the first module 12, the second module 14, and/or the third module 16.

Figures 6, 7:
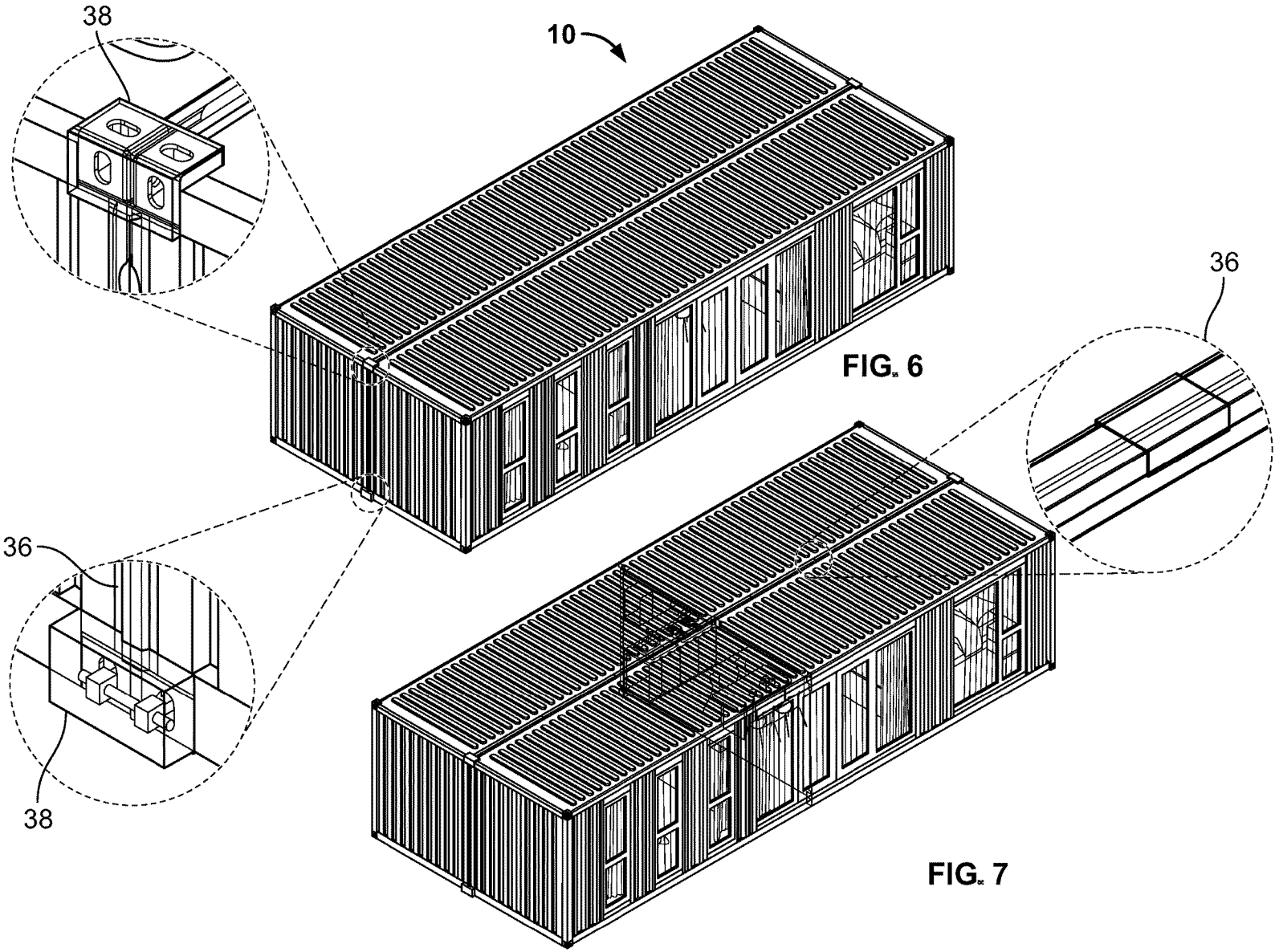
FIG. 6 is an isometric view of a modular structure or assembly, in accordance with some embodiments of the invention.
FIG. 7 is a partially transparent cutaway view of a modular structure or assembly, in accordance with some embodiments of the invention.

Referring to FIG. 6 and FIG. 7, in some embodiments, the modular structure 10 may further include a corner casting cover 38. In some embodiments, the corner casting cover 38 may be located over the corner castings 24 of the modules forming the modular structure 10. As shown in the figures, in some embodiments, the corner casting cover 38 may be arranged to fit at least partially over the cover 36. In some embodiments, the corner casting cover 38 substantially conceals the corner castings 24 of the modules and may reduce the incursion of water, dust, or other elements.

Figure 8:
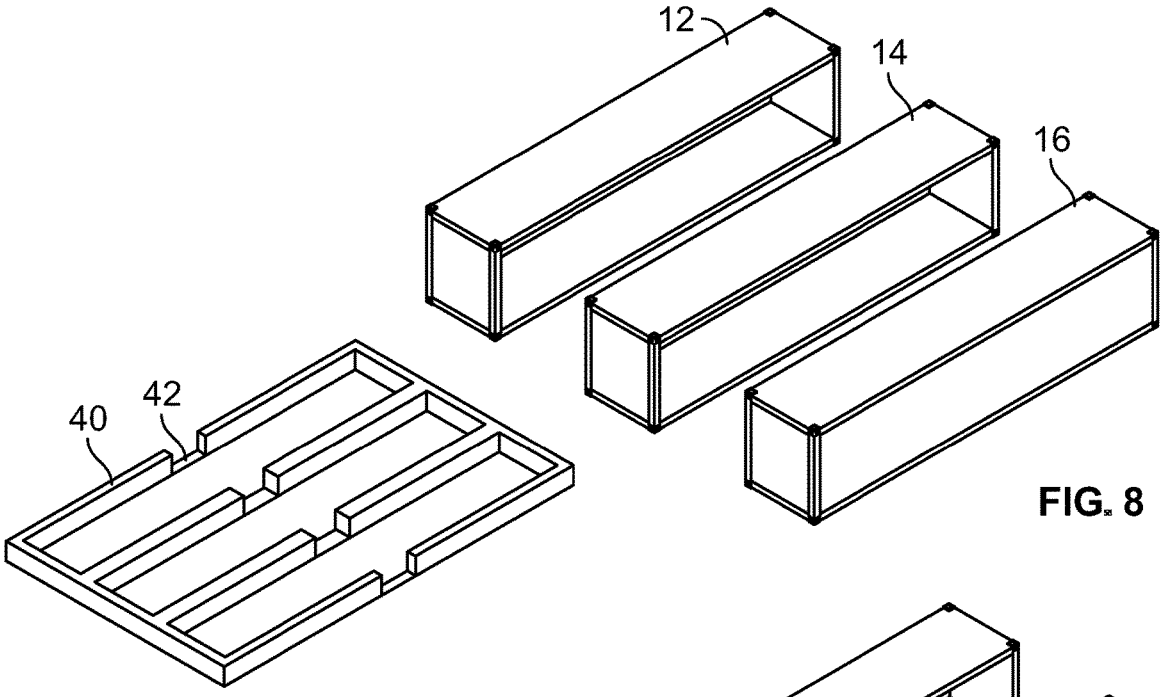
FIG. 8 is an isometric view of a foundation of a modular structure or assembly, in accordance with some embodiments of the invention.

In some embodiments, the invention includes methods of constructing the modular structure 10. Referring to FIG. 8-FIG. 27, in some embodiments, the modular structure 10 may be constructed from combinations of one or more of the first module 12, one or more of the second module 14, and/or one or more of the third module 16. As shown in FIG. 8, in some embodiments, a foundation 40 may be constructed. In some embodiments, the foundation 40 is sized according to a size of the modular structure 10, and may include portions that are configured to support the modules thereon. In some embodiments, the foundation 40 may be constructed on-site (e.g., at the building or construction site), such as at a desired location of the modular structure 10. In some embodiments, the foundation 40 may include one or more cutouts 42 for accessing an area underneath the modular structure 10. In some embodiments, the cutouts 42 may facilitate construction of the modular structure 10.

Figure 9:
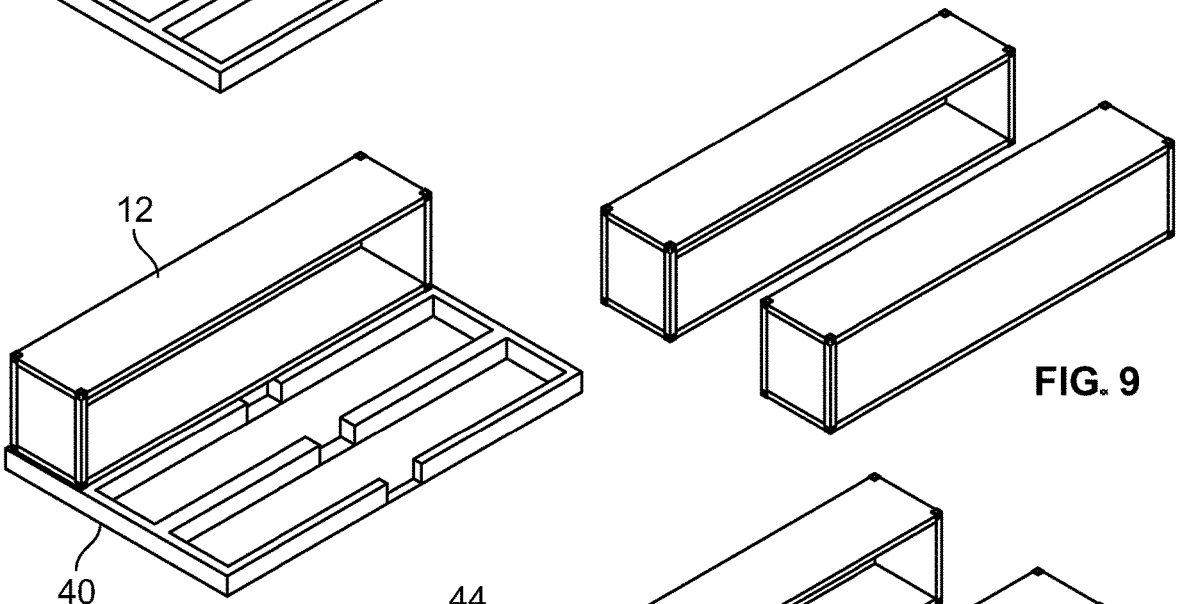
FIG. 9 is an isometric view illustrating the first module installed on a foundation of a modular structure, in accordance with some embodiments of the invention.
Figure 10:
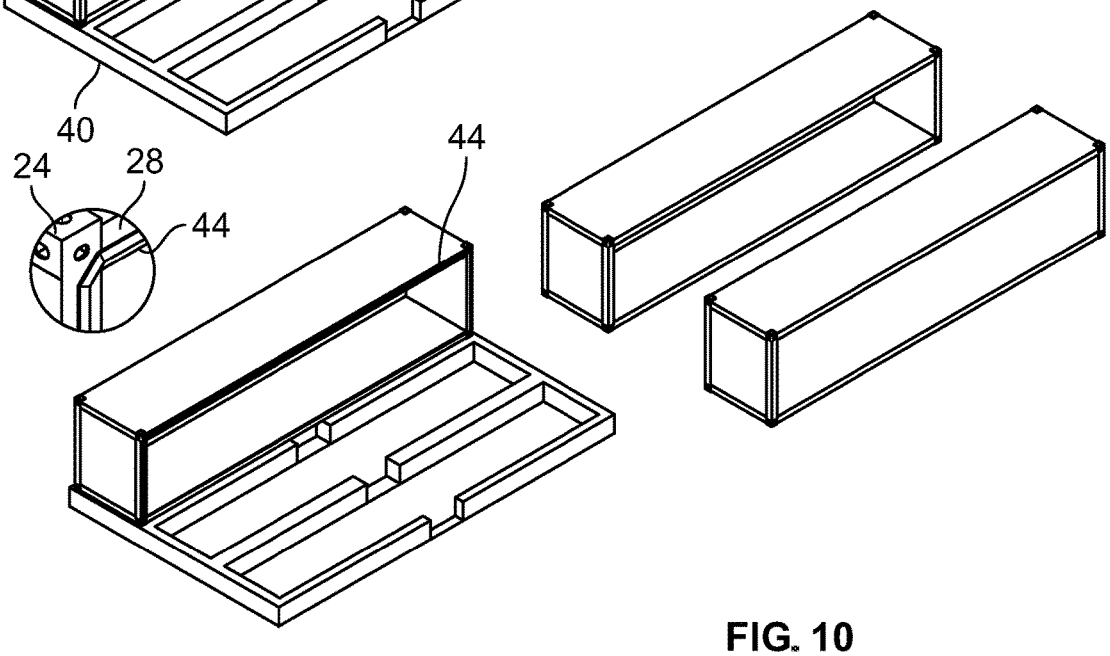
FIG. 10 is an isometric view and a detail view of a gasket on a first module, in accordance with some embodiments of the invention.
Figure 11:
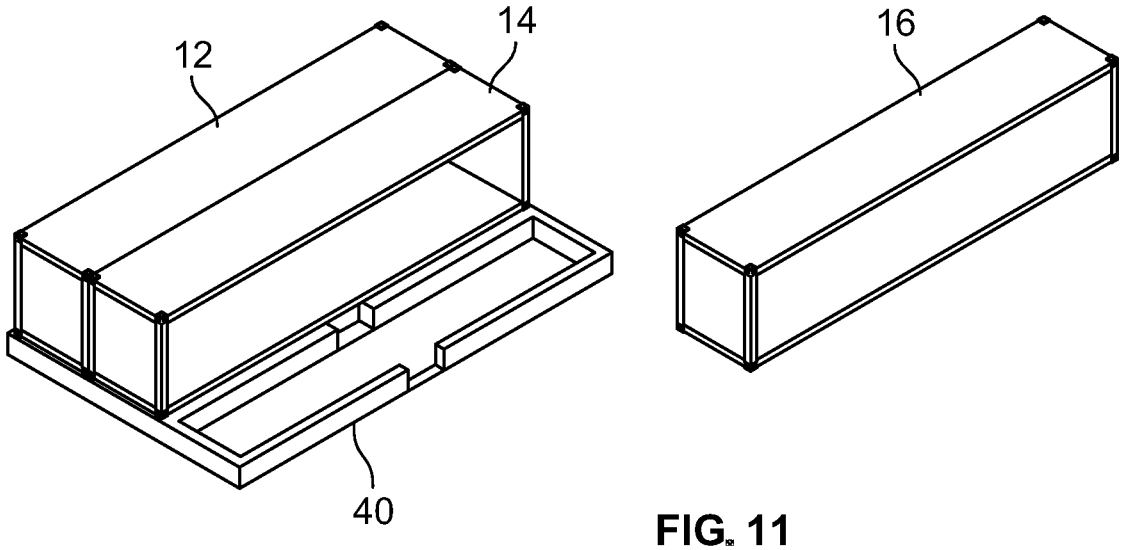
FIG. 11 is an isometric view of a first module and a second module installed on a foundation of a modular structure or assembly, in accordance with some embodiments of the invention.

Referring to FIG. 9, in some embodiments, one of the first module 12, the second module 14, and the third module 16 may be placed on the foundation 40. For example, in some embodiments, the first module 12 may be located towards an end of the foundation 40. Referring to FIG. 10, in some embodiments, a seal, such as a gasket 44 adhered by an adhesive, may be installed along one of the sides of the first module 12. In some embodiments, the gasket 44 may be, for example, a self-adhering gasket (e.g., a gasket with the adhesive). In some embodiments, the gasket 44 may be fixed on the flange area 28 (FIG. 3B) of the first module 12 located on the foundation 40. As shown in the detail view in FIG. 10, in some embodiments, the gasket 44 may be located substantially inward of the corner castings 24 of the module. Referring to FIG. 11, in some embodiments, the second module 14 may be placed on the foundation 40 against the first module 12. In some embodiments, the gasket 44 may have a thickness such that the first module 12 is spaced-apart from the second module 14 a distance corresponding to a thickness of the gasket 44.

Figure 12:
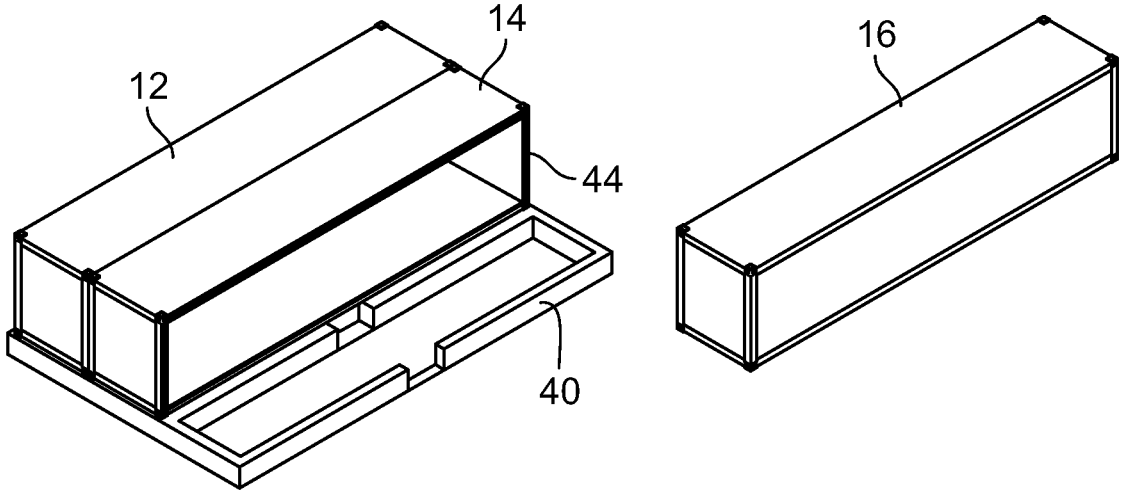
FIG. 12 shows a gasket installed on a second module according to one aspect of the present disclosure.
Figure 13:
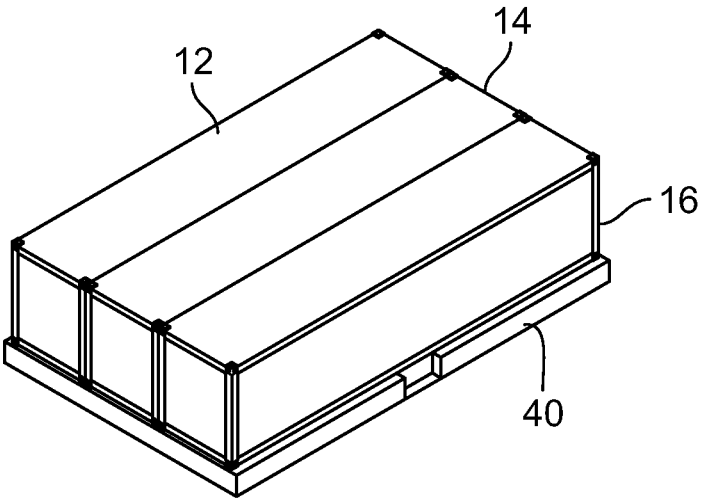
FIG. 13 shows a third module installed on a foundation of a modular structure according to one aspect of the present disclosure.

For example, in some embodiments, the gasket 44 may separate the first module 12 from the second module 14 by a distance of from about 5 mm to about 20 mm. In some embodiments, the distance may be about 5 mm to 15 mm. In some embodiments, the distance may be about 5 mm to 10 mm. In some embodiments, the distance may be about 10 mm to 20 mm. In some embodiments, the distance may be about 10 mm to 15 mm. In some embodiments, the distance may be about 15 mm to 20 mm. In some embodiments, the gasket 44 is installed around a side of the second module 14 that is distal from the first module 12, as shown in FIG. 12. In some embodiments, the gasket 44 may be the same type as installed on the first module 12. Referring to FIG. 13, in some embodiments, the third module 16 may be placed on the foundation 40. In some embodiments, the third module 16 may be spaced-apart from the second module 14 with the gasket 44 as described.

Figure 14:
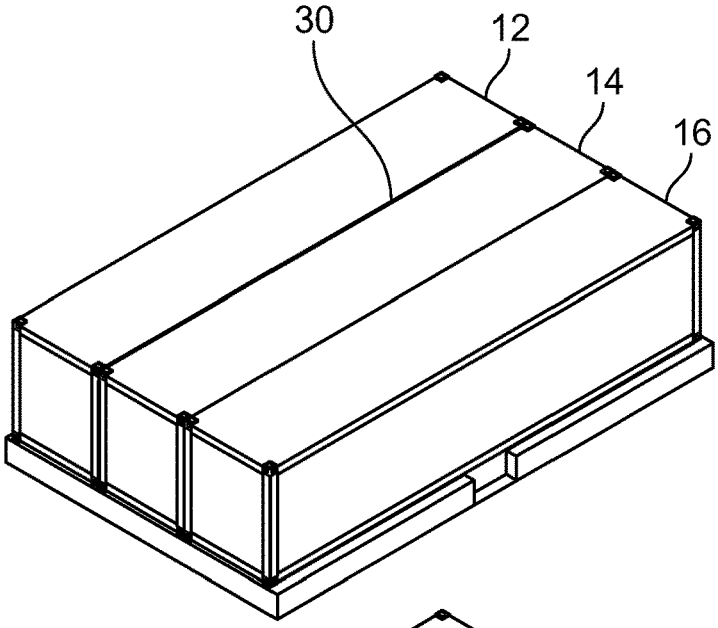
FIG. 14 shows a sealing member installed between a first module and a second module of a modular structure according to one aspect of the present disclosure.
Figure 15:
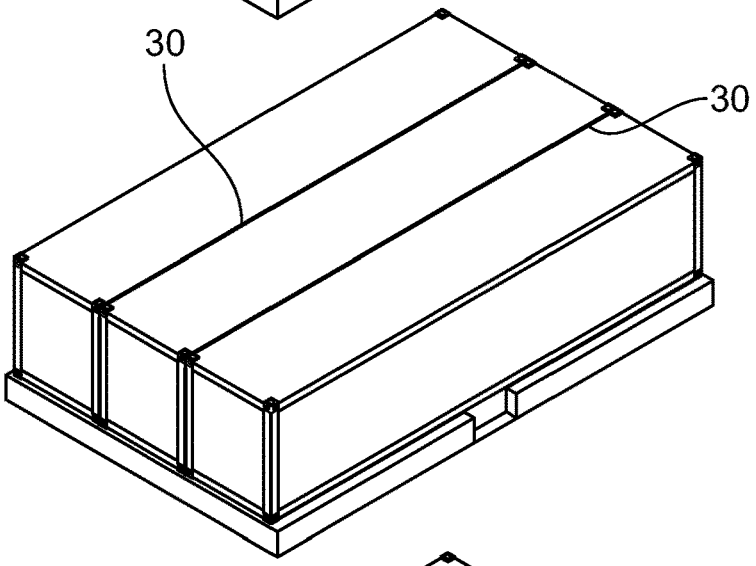
FIG. 15 shows a sealing member installed between a second module and a third module of a modular structure according to one aspect of the present disclosure.
Figure 16:
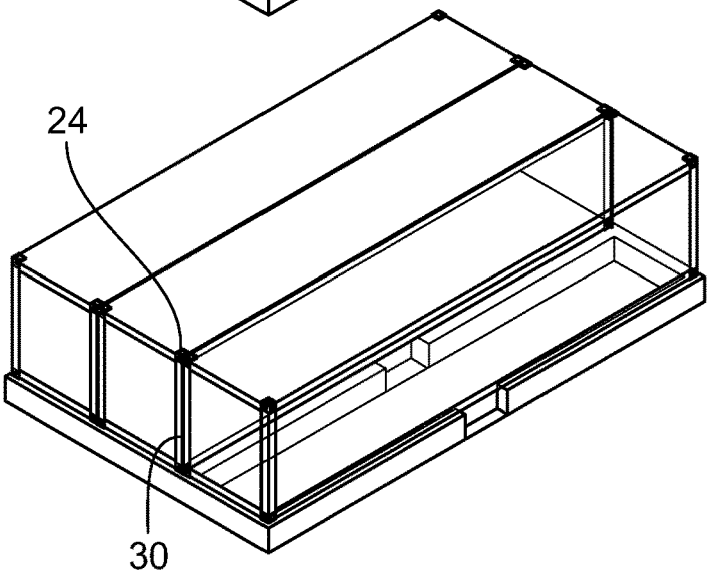
FIG. 16 shows a transparent view of a sealing member installed on modules of a modular structure according to one aspect of the present disclosure.

Referring to FIG. 14-FIG. 16, in some embodiments, the sealing member 30 is installed between the first module 12 and the second module 14. In some embodiments, the sealing member 30 is installed and between the second module 14 and the third module 16. In some embodiments, the sealing member 30 may be installed along a top edge and side edges of the portion between the first module 12, the second module 14, and/or the third module 16. In some embodiments, the sealing member 30 may be sized to fit between the gap created by the gasket 44. As shown in FIG. 16, in some embodiments, the sealing member 30 may be arranged at corners of the modules to be located inward from the plurality of corner castings 24. In some embodiments, the sealing member 30 may be routed around any holes of the plurality of corner castings 24 to reduce incursion of water through a portion between the modules.

Figure 17:
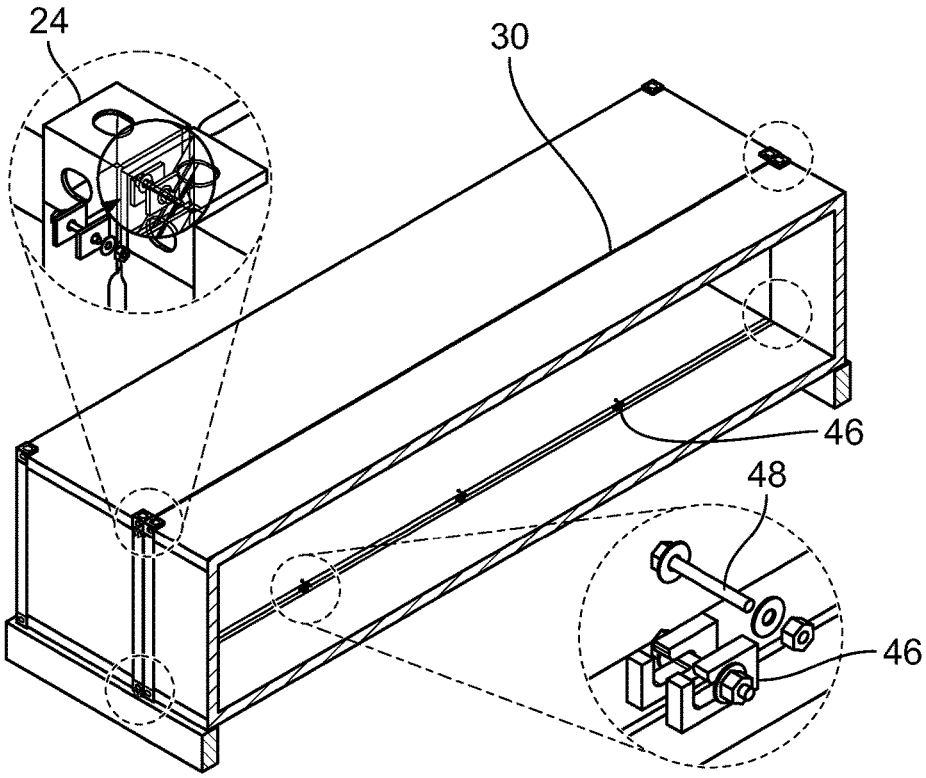
FIG. 17 shows a close-up view of a plurality of fastener points of a modular structure according to one aspect of the present disclosure.
Figure 18:
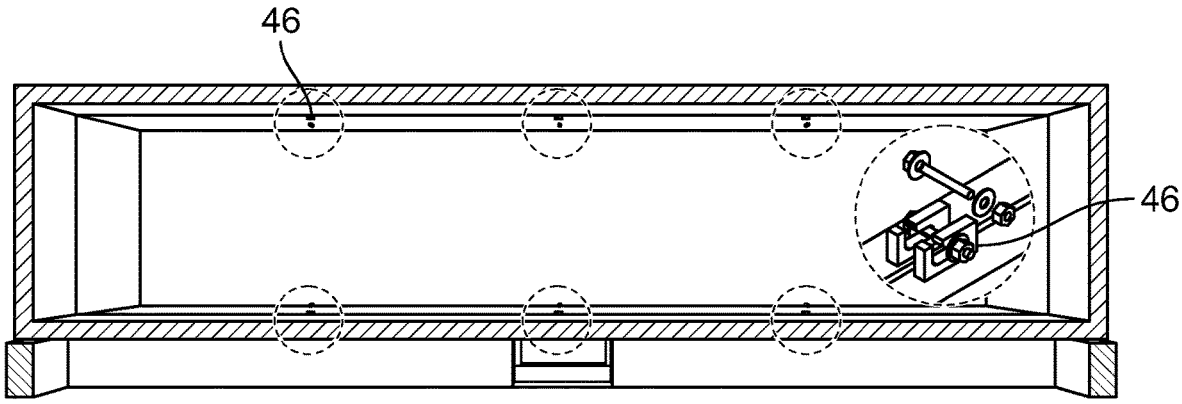
FIG. 18 shows a side view of a plurality of fastener points of a modular structure according to one aspect of the present disclosure.

In some embodiments, the first module 12, the second module 14, and/or the third module 16 may be secured to one another during construction of the modular structure 10. As shown in FIG. 17 and FIG. 18, the first module 12, the second module 14, and/or the third module 16 may be secured to one another with a plurality of fasteners. In some embodiments, one or more of the first module 12, the second module 14, and/or the third module 16 may include a plurality of fastener receiving portions. In some embodiments, the fastener receiving portions may be fastener points 46, which are located around sides one or more of the first module 12, the second module 14, and/or the third module 16. In some embodiments, the plurality of fastener points 46 may be arranged, for example, proximate to the flange area 28 (FIG. 3B). In some embodiments, the plurality of fastener points 46 may include a hook-shaped portion, as shown in FIG. 17. In some embodiments, a plurality of fasteners 48 may be engaged with the plurality of fastener points 46 to secure the first module 12, the second module 14, and/or the third module 16 to one another. In some embodiments, the first module 12, the second module 14, and/or the third module 16 may further include one or more fasteners located through portions of the corner castings 24, to secure the first module 12, the second module 14, and/or the third module 16 to one another at the corner castings 24. In some embodiments, the first module 12, the second module 14, and/or the third module 16 are secured to one another to maintain the first module 12, the second module 14, and/or the third module 16 tightly against the gasket 44 and the sealing member 30, to seal the first module 12, the second module 14, and/or the third module 16 to one another.

Figure 19:
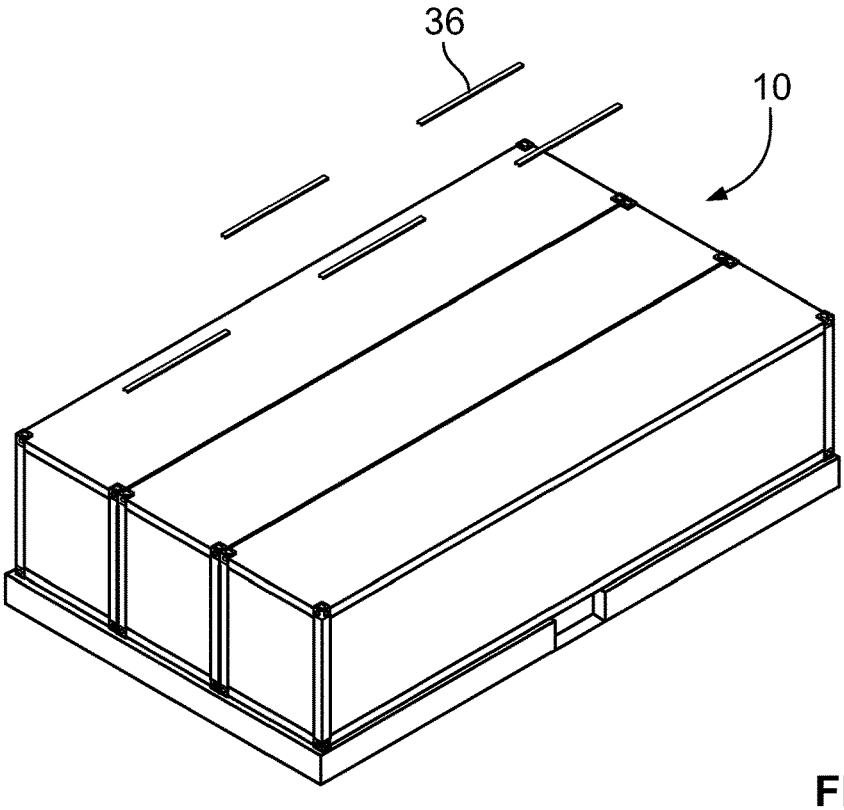
FIG. 19 and FIG. 20 show a plurality of covers installed along a top of a modular structure according to one aspect of the present disclosure.
Figure 20:
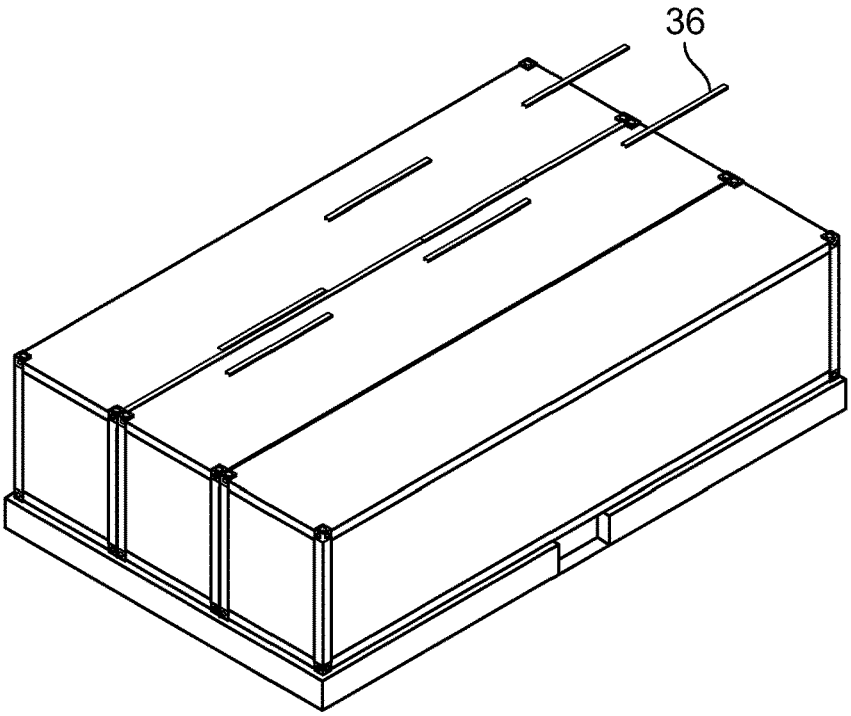
Figure 21:
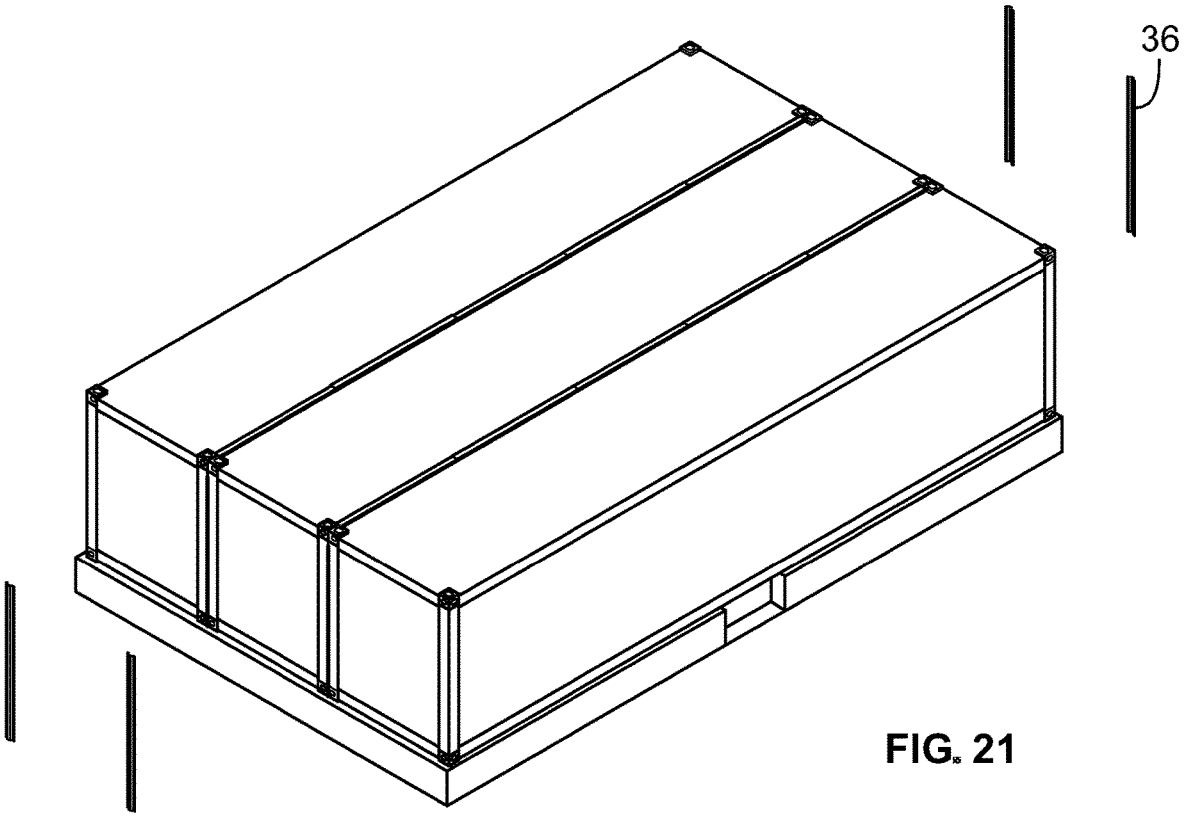
FIG. 21, FIG. 22, FIG. 23, and FIG. 24 show a plurality of covers installed along sides of a modular structure according to one aspect of the present disclosure.
Figure 22:
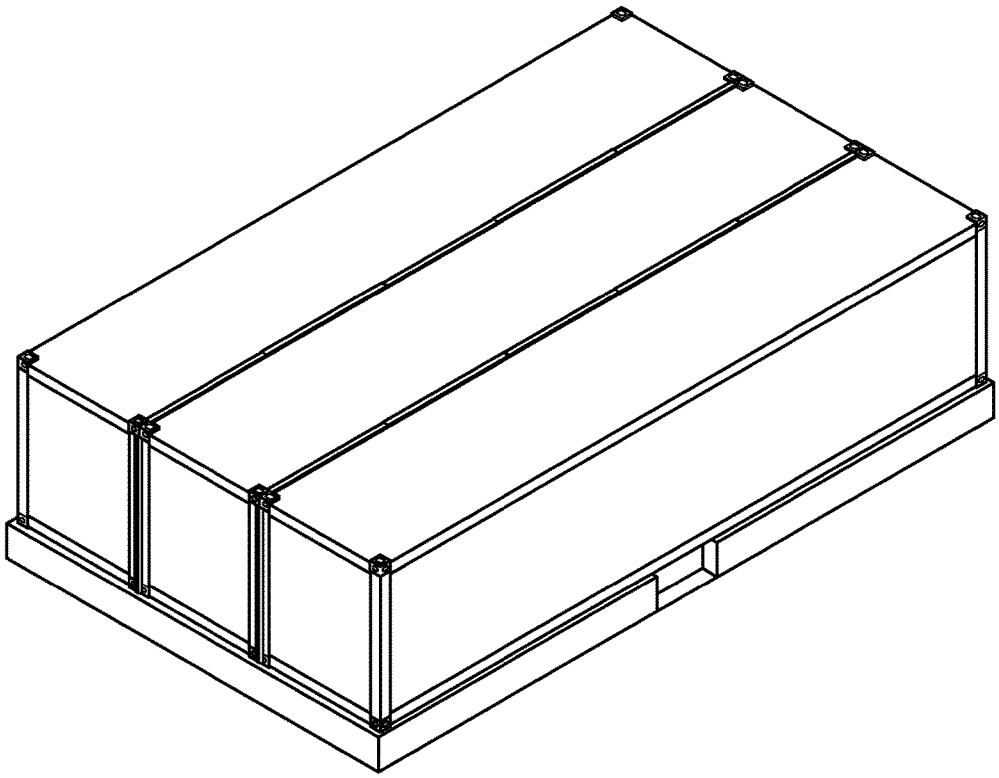
Figure 23:
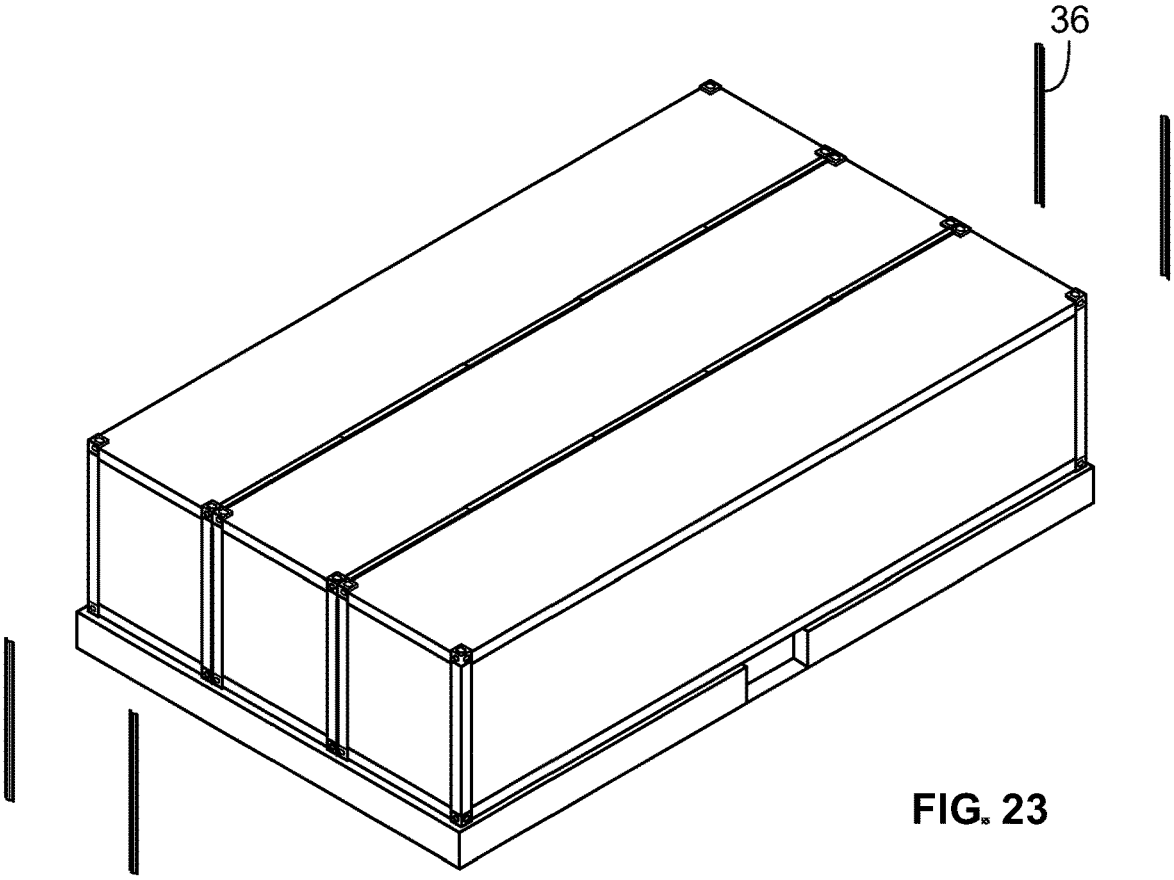
Figure 24:
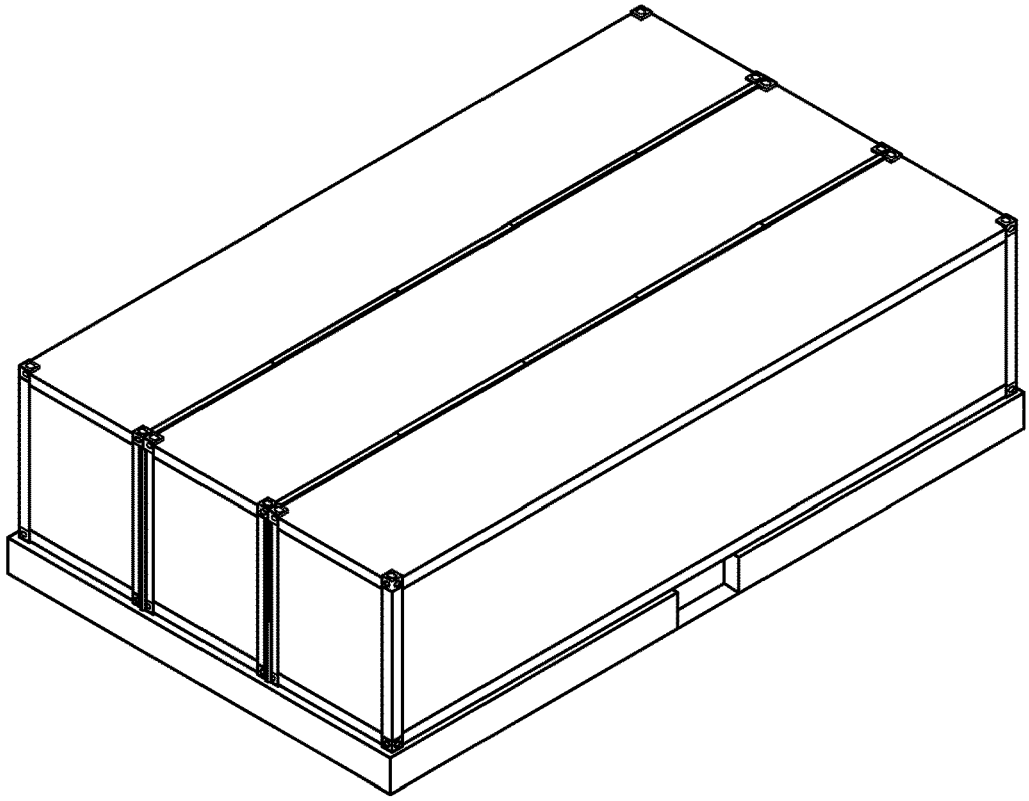

Referring to FIG. 19 and FIG. 20, in some embodiments, a plurality of the cover 36 may be secured along portions of the modular structure 10 where the first module 12, the second module 14, and/or the third module 16 are joined together. In some embodiments, the cover 36 may be placed substantially over the sealing member 30 and the gasket 44. In some embodiments, the cover 36 may be arranged in sections along lengths of the portions where the first module 12, the second module 14, and/or the third module 16 are joined together and may be arranged along a top and sides (FIG. 21, FIG. 22, FIG. 23, and FIG. 24) of the modular structure 10 at joints between the first module 12, the second module 14, and/or the third module 16. In some embodiments, sections of the cover 36 may overlap with adjoining sections of the cover 36 to substantially continuously cover the portion at which the first module 12, the second module 14, and/or the third module 16 are joined.

Figure 25:
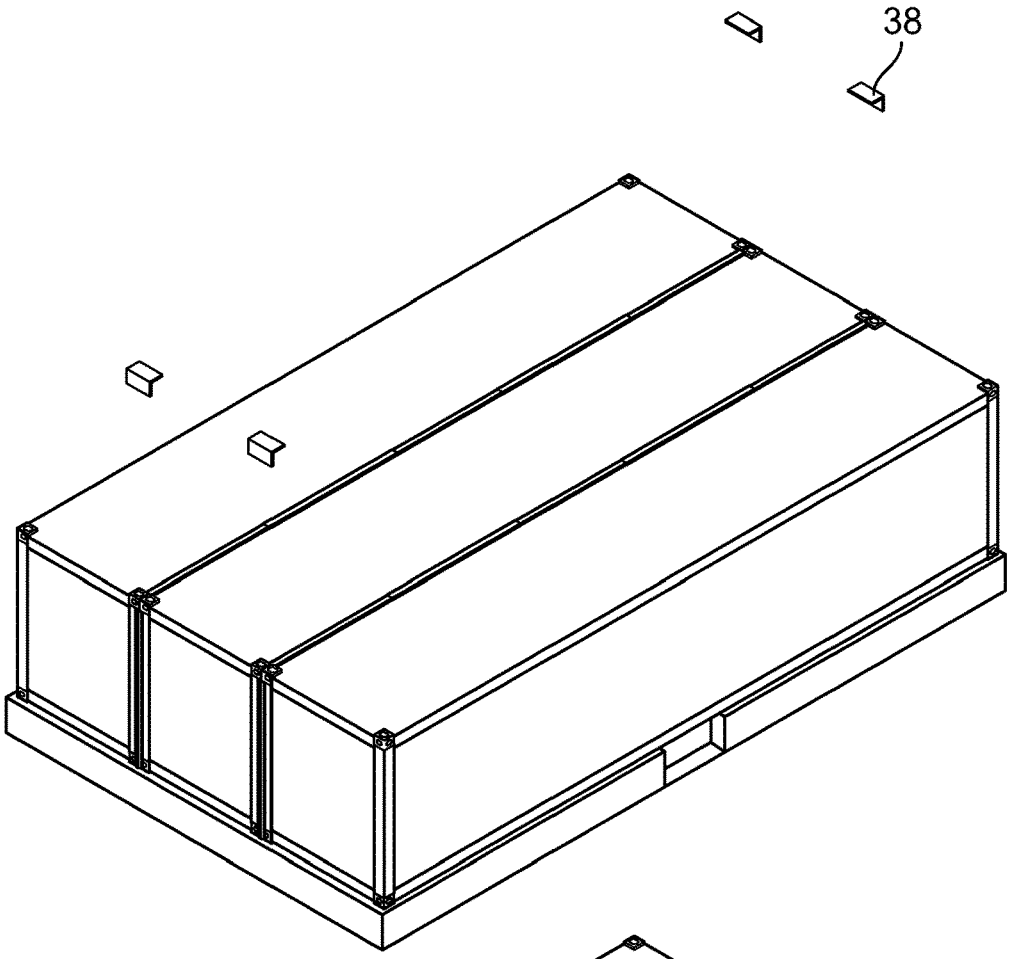
FIG. 25 and FIG. 26 show a plurality of corner casting covers installed on a modular structure according to one aspect of the present disclosure.
Figure 26:
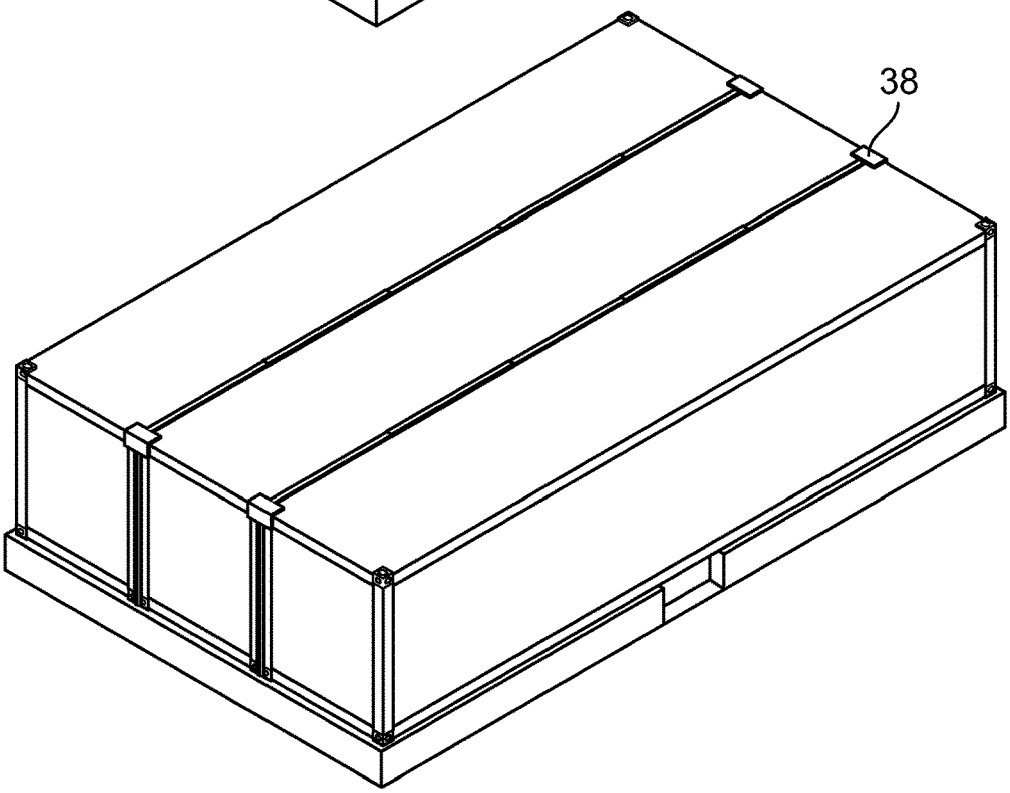

In some embodiments, a plurality of the corner casting cover 38 may be installed on the modular structure at the corner castings 24 of the first module 12, the second module 14, and/or the third module 16. In some embodiments, the corner casting cover 38 may be installed over a portion at which casting covers 24 of adjoining ones of the first module 12, the second module 14, and/or the third module 16 are adjacent to one another, as shown in FIG. 25 and FIG. 26. In some embodiments, the corner casting cover 38 substantially covers the corner castings 24 of the modules when installed.

Figure 27:
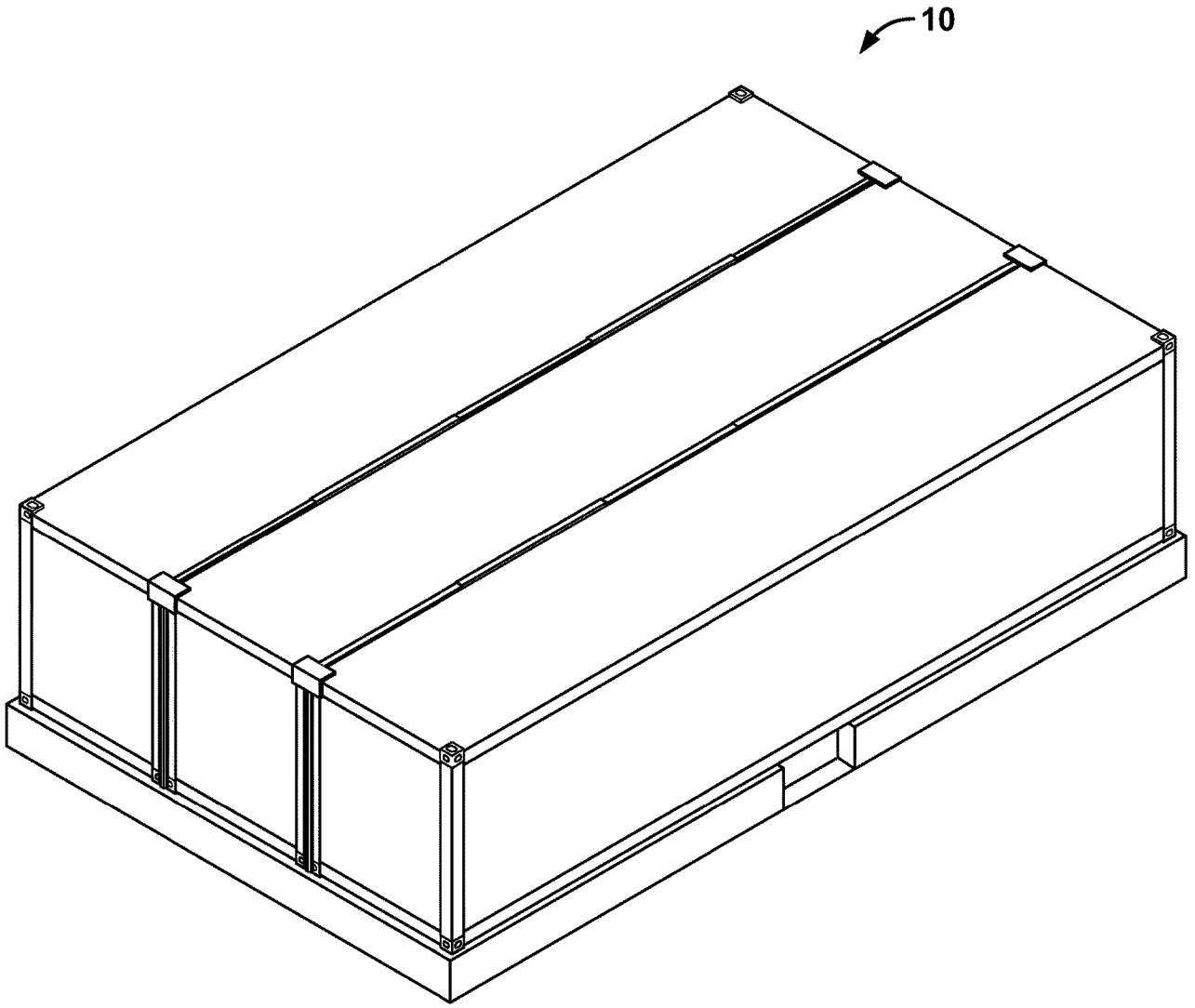
FIG. 27 shows a perspective view of a modular structure according to one aspect of the present disclosure.

An embodiment of the modular structure 10 is shown in FIG. 27. In some embodiments, when assembled with one another, the first module 12, the second module 14, and/or the third module 16 of the modular structure 10 are substantially sealed relative to one another, to create a durable and substantially weather-resistant structure. In some embodiments, seams and corner castings of the modules are substantially concealed by the corner casting cover 38 and the cover 36.

Thus, in some embodiments, the modular structure 10 may be advantageously built in sections prior to assembly of the modular structure 10. For examples, the first module 12, the second module 14, and/or the third module 16 may be constructed off-site and readily transported to a desired location of the modular structure. In some embodiments, the first module 12, the second module 14, and/or the third module 16 are adapted to be readily installed adjacent to one another in a variety of configurations depending on a desired layout of the modular structure 10.

Variations, modifications, and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A modular assembly, comprising:

a plurality of modules, wherein the plurality of modules comprises a first module, a second module, and a third module, wherein each of the first module, the second module, and the third module comprises:

an upper wall, a lower wall opposite the upper wall, a first end wall extending between the upper wall and the lower wall, a second end wall:

opposite the first end wall, and extending between the upper wall and the lower wall, and a first side wall extending:

between the upper wall and the lower wall, and between the first end wall and the second end wall, wherein the first side wall defines a first opening, wherein the second module further comprises:

a second side wall extending:

between the upper wall of the second module and the lower wall of the second module, and between the first end wall of the second module and the second end wall of the second module, wherein the second side wall defines a second opening;

a first interior gasket between the first side wall of the first module and the first side wall of the second module;

a second interior gasket between the second side wall of the second module and the first side wall of the third module;

a first exterior sealing member between the first end wall of the first module and the first end wall of the second module;

a second exterior sealing member between the first end wall of the second module and the first end wall of the third module;

a third exterior sealing member between the second end wall of the first module and the second end wall of the second module;

a fourth exterior sealing member between the second end wall of the second module and the second end wall of the third module;

a fifth exterior sealing member between the upper wall of the first module and the upper wall of the second module;

a sixth exterior sealing member between the upper wall of the second module and the upper wall of the third module; and an adhesive, wherein the adhesive adheres the first interior gasket to at least one of the first side wall of the first module or the first side wall of the second module.

2. The modular assembly of claim 1, further comprising:

a foundation, wherein the foundation supports each of the first module, the second module, and the third module.

3. The modular assembly of claim 1, wherein the first module comprises:

a second side wall extending:

between the upper wall of the first module and the lower wall of the first module, and between the first end wall of the first module and the second end wall of the first module, wherein the second side wall of the first module includes a door.

4. The modular assembly of claim 1, wherein the first module comprises:

a second side wall extending:

between the upper wall of the first module and the lower wall of the first module, and between the first end wall of the first module and the second end wall of the first module, wherein the second side wall of the first module includes a window.

5. The modular assembly of claim 1, further comprising:

a cover on at least one of the first exterior sealing member, the second exterior sealing member, the third exterior sealing member, the fourth exterior sealing member, the fifth exterior sealing member, or the sixth exterior sealing member.

6. The modular assembly of claim 1, further comprising:

a first cover on the first exterior sealing member;

a second cover on the second exterior sealing member;

a third cover on the third exterior sealing member;

a fourth cover on the fourth exterior sealing member;

a fifth cover on the fifth exterior sealing member; and a sixth cover on the sixth exterior sealing member.

7. The modular assembly of claim 1, further comprising:

at least one fastener, wherein the at least one fastener fastens the first module and the second module to one another.

8. The modular assembly of claim 1, wherein the first module further comprises:

a first fastener receiving portion on the lower wall of the first module, wherein the second module further comprises:

a second fastener receiving portion on the lower wall of the second module, wherein the modular assembly further comprises:

a first fastener, wherein the first fastener fastens the first fastener receiving portion and the second fastener receiving portion to one another.

9. The modular assembly of claim 1, wherein the first module further comprises:

a first fastener receiving portion on the upper wall of the first module, wherein the second module further comprises:

a second fastener receiving portion on the upper wall of the second module, wherein the modular assembly further comprises:

a first fastener, wherein the first fastener fastens the first fastener receiving portion and the second fastener receiving portion to one another.

10. A modular assembly, comprising:

a plurality of modules, wherein the plurality of modules comprises a first module and a second module, wherein each of the first module and the second module comprises:

an upper wall, a lower wall opposite the upper wall, a first end wall extending between the upper wall and the lower wall, a second end wall:

opposite the first end wall, and extending between the upper wall and the lower wall, and a first side wall extending:

between the upper wall and the lower wall, and between the first end wall and the second end wall, wherein the first side wall defines a first opening;

a first interior gasket between the first side wall of the first module and the first side wall of the second module;

a first exterior sealing member between the first end wall of the first module and the first end wall of the second module;

a second exterior sealing member between the second end wall of the first module and the second end wall of the second module;

a third exterior sealing member between the upper wall of the first module and the upper wall of the second module; and an adhesive, wherein the adhesive adheres the first interior gasket to at least one of the first side wall of the first module or the first side wall of the second module.

11. The modular assembly of claim 10, further comprising:

a foundation, wherein the foundation supports each of the first module and the second module.

12. The modular assembly of claim 10, wherein the first module comprises:

a second side wall extending:

between the upper wall of the first module and the lower wall of the first module, and between the first end wall of the first module and the second end wall of the first module, wherein the second side wall of the first module includes a door.

13. The modular assembly of claim 10, wherein the first module comprises:

a second side wall extending:

between the upper wall of the first module and the lower wall of the first module, and between the first end wall of the first module and the second end wall of the first module, wherein the second side wall of the first module includes a window.

14. The modular assembly of claim 10, further comprising:

a cover on at least one of the first exterior sealing member, the second exterior sealing member, or the third exterior sealing member.

15. The modular assembly of claim 10, further comprising:

a first cover on the first exterior sealing member;

a second cover on the second exterior sealing member; and a third cover on the third exterior sealing member.

16. The modular assembly of claim 10, further comprising:

at least one fastener, wherein the at least one fastener fastens the first module and the second module to one another.

17. The modular assembly of claim 10, wherein the first module further comprises:

a first fastener receiving portion on the lower wall of the first module, wherein the second module further comprises:

a second fastener receiving portion on the lower wall of the second module, wherein the modular assembly further comprises:

a first fastener, wherein the first fastener fastens the first fastener receiving portion and the second fastener receiving portion to one another.

18. The modular assembly of claim 10, wherein the first module further comprises:

a first fastener receiving portion on the upper wall of the first module, wherein the second module further comprises:

a second fastener receiving portion on the upper wall of the second module, wherein the modular assembly further comprises:

a first fastener, wherein the first fastener fastens the first fastener receiving portion and the second fastener receiving portion to one another.

* * * * *